US009850612B2

(12) United States Patent
Bae et al.

(10) Patent No.: US 9,850,612 B2
(45) Date of Patent: Dec. 26, 2017

(54) LAUNDRY TREATING APPARATUS

(71) Applicant: LG Electronics Inc., Seoul (KR)

(72) Inventors: Jinwoo Bae, Seoul (KR); Hongjun Cho, Seoul (KR); Sanghun Bae, Seoul (KR); Kyungmun Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 736 days.

(21) Appl. No.: 14/192,373

(22) Filed: Feb. 27, 2014

(65) Prior Publication Data

US 2014/0238088 A1 Aug. 28, 2014

(30) Foreign Application Priority Data

Feb. 28, 2013 (KR) ..... 10-2013-0021851

(51) Int. Cl.

| | |
|---|---|
| ***D06F 31/00*** | (2006.01) |
| ***D06F 58/02*** | (2006.01) |
| ***D06F 58/10*** | (2006.01) |
| ***D06F 58/20*** | (2006.01) |
| ***D06F 29/00*** | (2006.01) |
| *D06F 39/12* | (2006.01) |
| *D06F 25/00* | (2006.01) |

(52) U.S. Cl.

CPC ..... *D06F 31/00* (2013.01); *D06F 29/005* (2013.01); *D06F 58/02* (2013.01); *D06F 58/10* (2013.01); *D06F 58/20* (2013.01); *D06F 25/00* (2013.01); *D06F 39/125* (2013.01)

(58) Field of Classification Search

CPC ..... D06F 31/00; D06F 29/005; D06F 58/10

See application file for complete search history.

(56) References Cited

U.S. PATENT DOCUMENTS

| | | | | |
|---|---|---|---|---|
| 3,555,701 | A | 1/1971 | Hubbard | |
| 7,866,057 | B2 | 1/2011 | Grunert et al. | |
| 2007/0119072 | A1 | 5/2007 | Kim | |
| 2010/0005681 | A1* | 1/2010 | Jo | D06F 25/00 34/215 |
| 2011/0099835 | A1 | 5/2011 | Kim et al. | |

FOREIGN PATENT DOCUMENTS

| | | | |
|---|---|---|---|
| CA | 2664469 | C | 12/2012 |
| CN | 101517147 | A | 8/2009 |
| CN | 102597356 | A | 7/2012 |

(Continued)

*Primary Examiner* — David Cormier

(74) *Attorney, Agent, or Firm* — Dentons US LLP

(57) ABSTRACT

A laundry treating apparatus is disclosed. The laundry treating apparatus includes a first cabinet having a first receiving space to receive laundry, a second cabinet having a second receiving space to receive laundry, the second cabinet being separated from the first cabinet, a partition wall located at an upper part of the second receiving space to divide an interior of the second cabinet, a supply unit to selectively supply air to the first receiving space and the second receiving space, a discharge unit including an exhaust duct to discharge air in the first receiving space out of the first cabinet and a suction fan provided in the partition wall such that the suction fan is located in the second cabinet to suction air from the second receiving space such that the air from the second receiving space moves to the exhaust duct.

18 Claims, 11 Drawing Sheets

(56) References Cited

FOREIGN PATENT DOCUMENTS

| | | | |
|---|---|---|---|
| KR | 10-0710315 | B1 | 4/2007 |
| KR | 10-0774208 | B1 | 11/2007 |
| WO | 2008013411 | A2 | 1/2008 |
| WO | 2008013413 | A2 | 1/2008 |
| WO | 2011/055974 | A2 | 5/2011 |
| WO | 2012/174853 | A1 | 12/2012 |

* cited by examiner

【Figure 1】
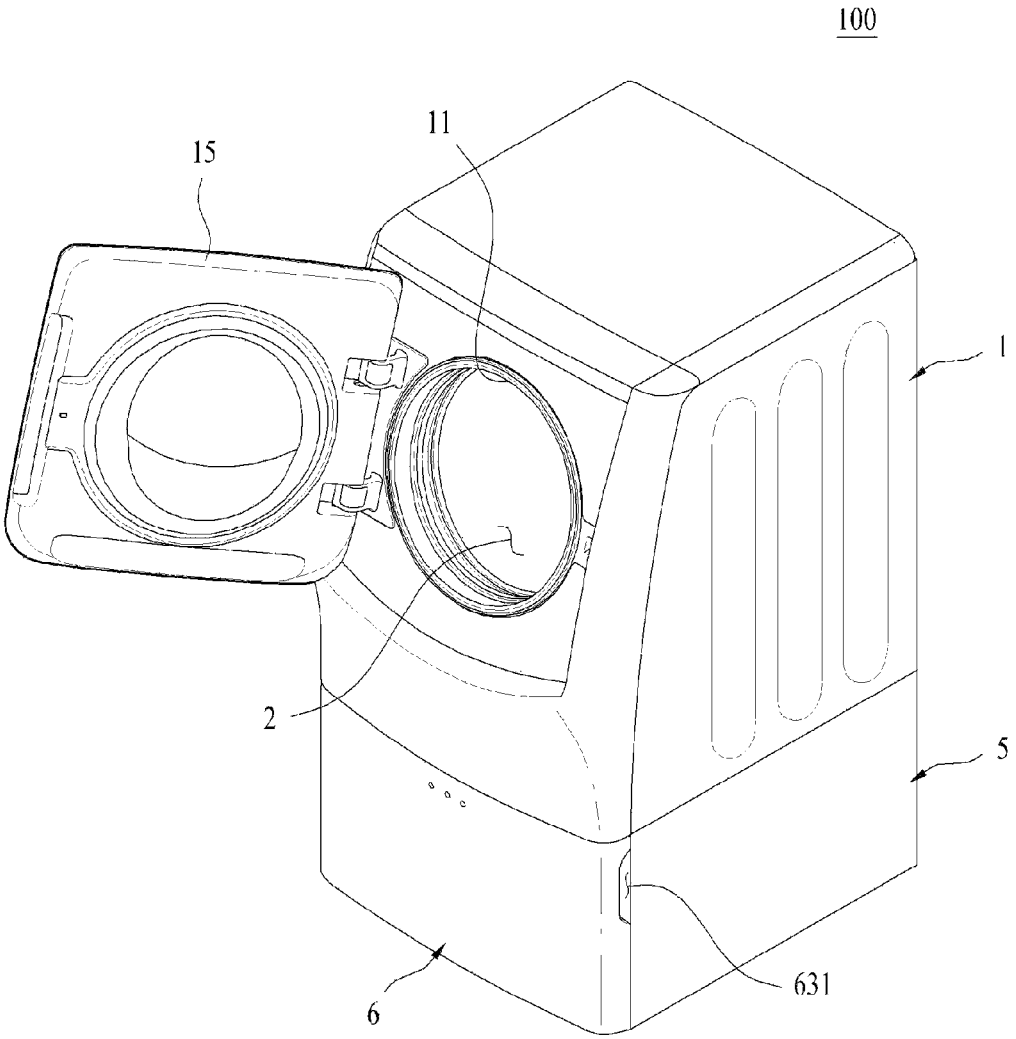

【Figure 2】
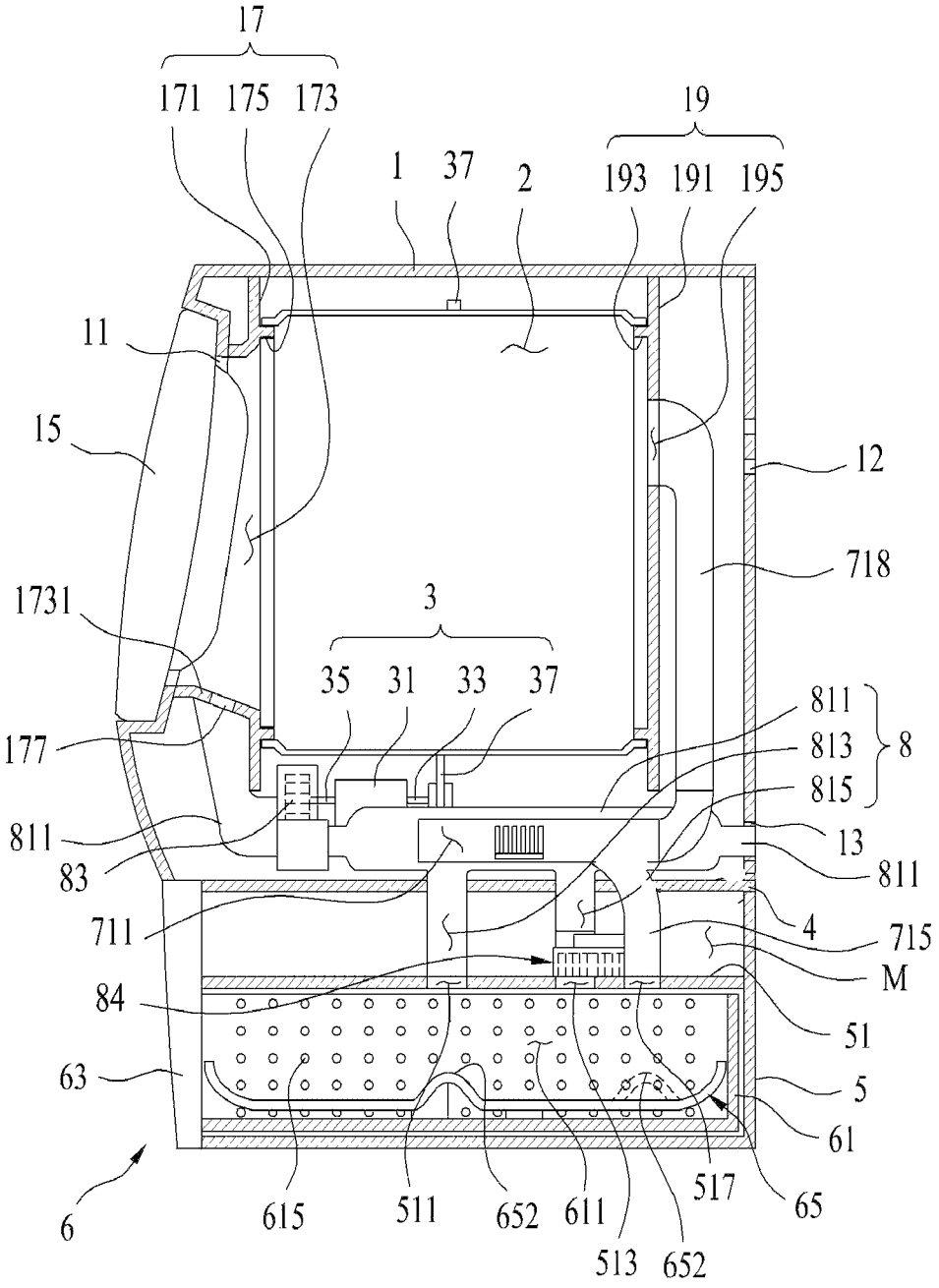

【Figure 3】
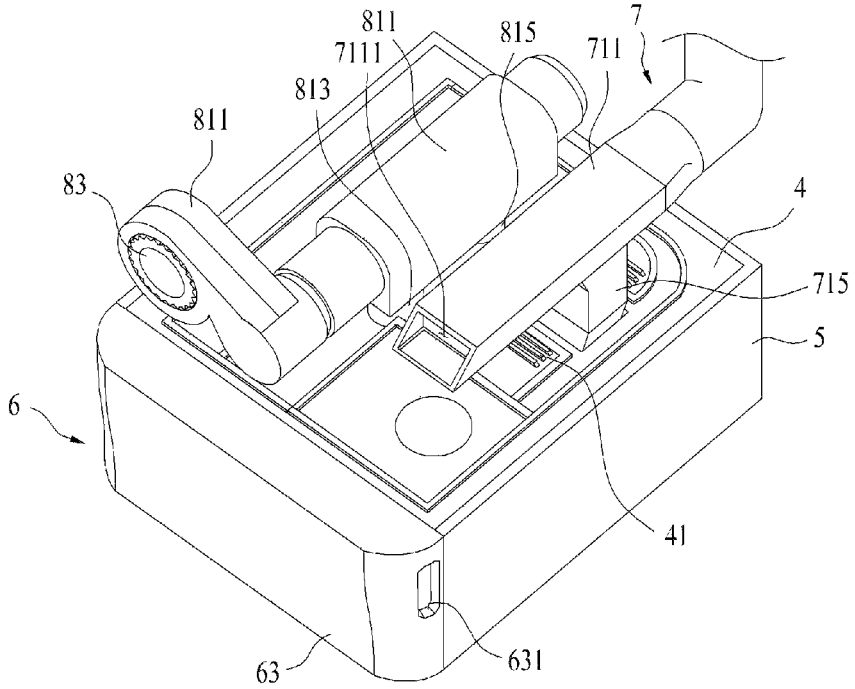
(a)
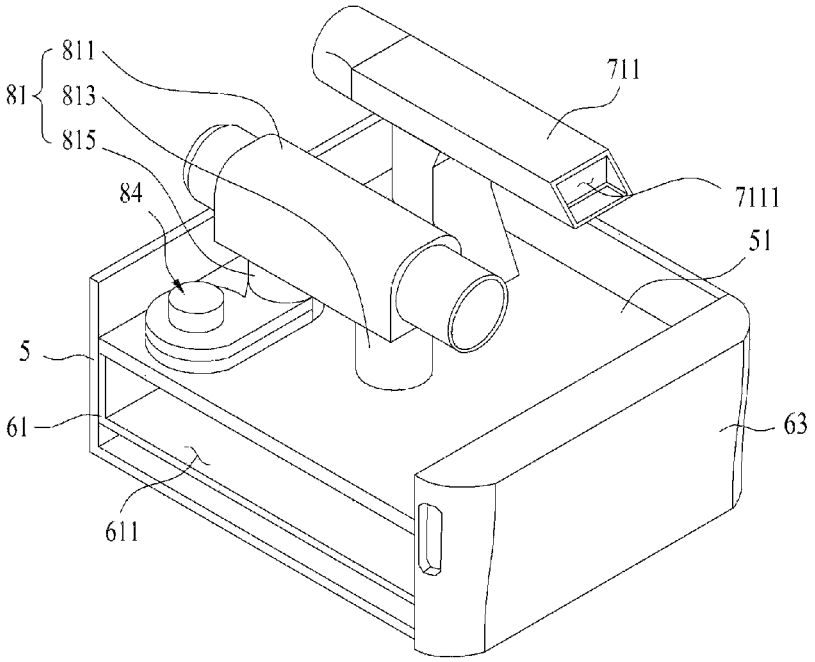
(b)

【Figure 4】
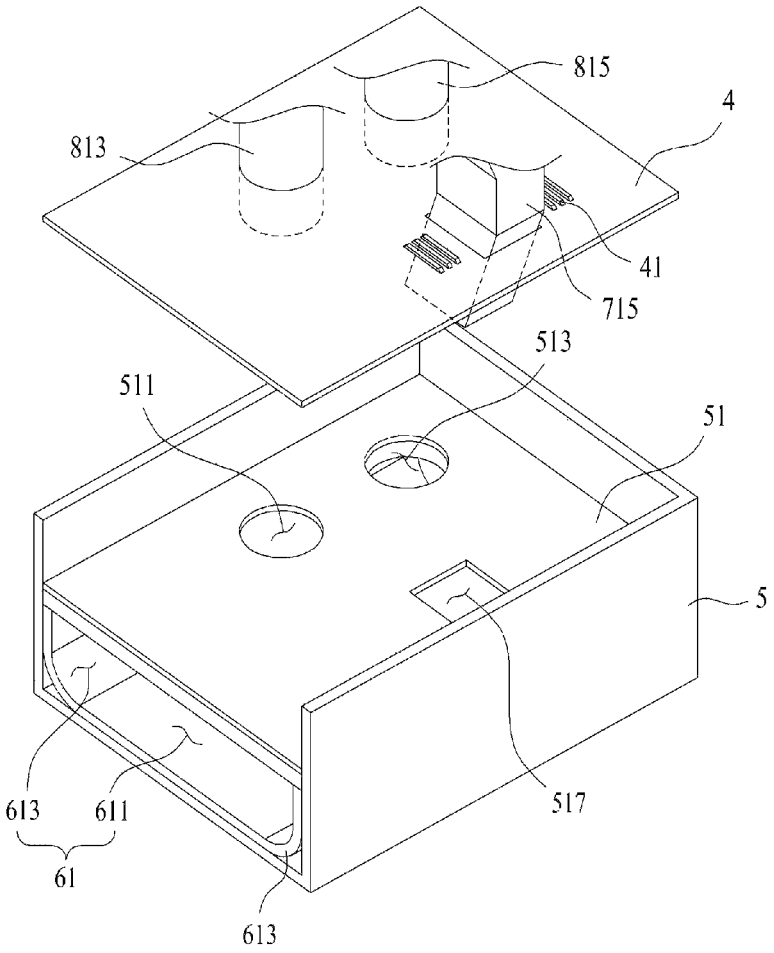

【Figure 5】
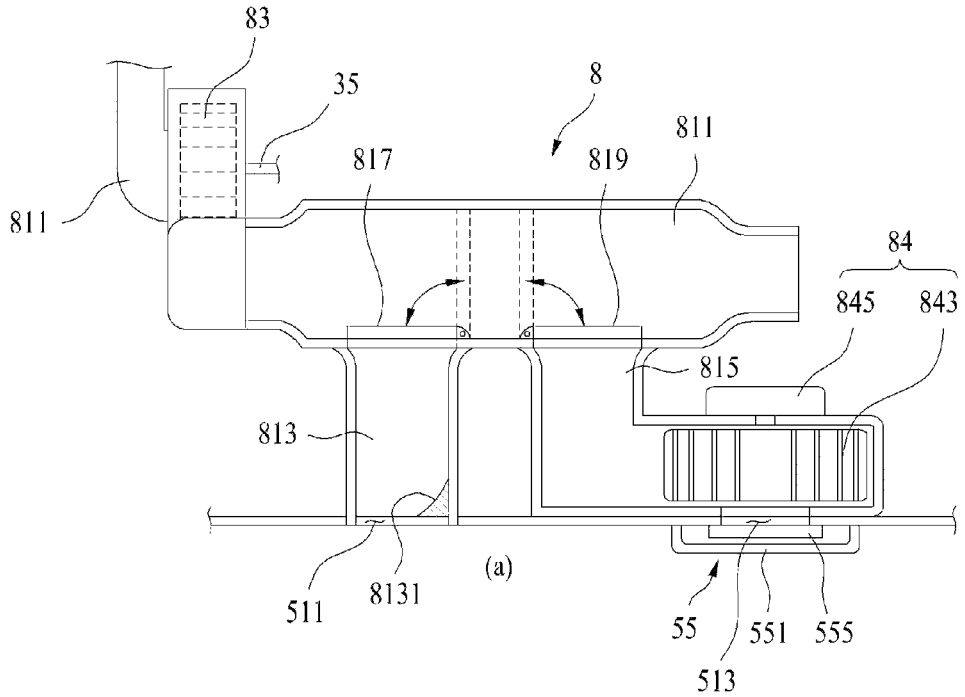
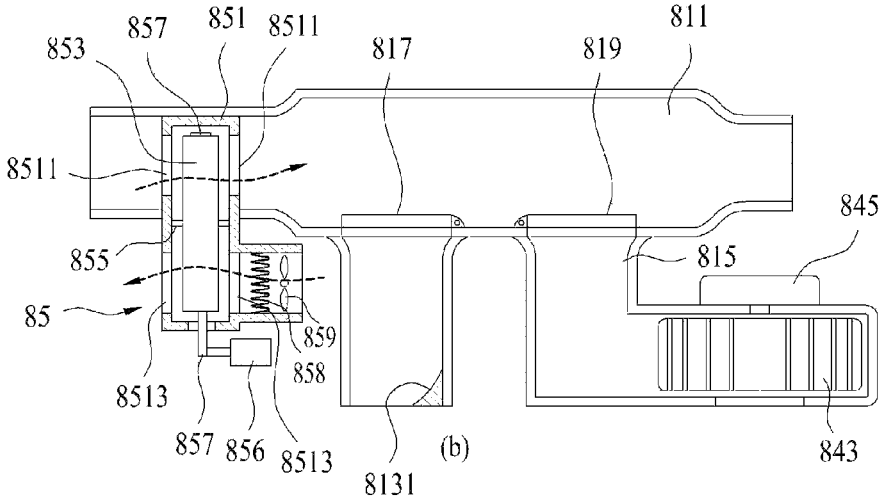

【Figure 6】
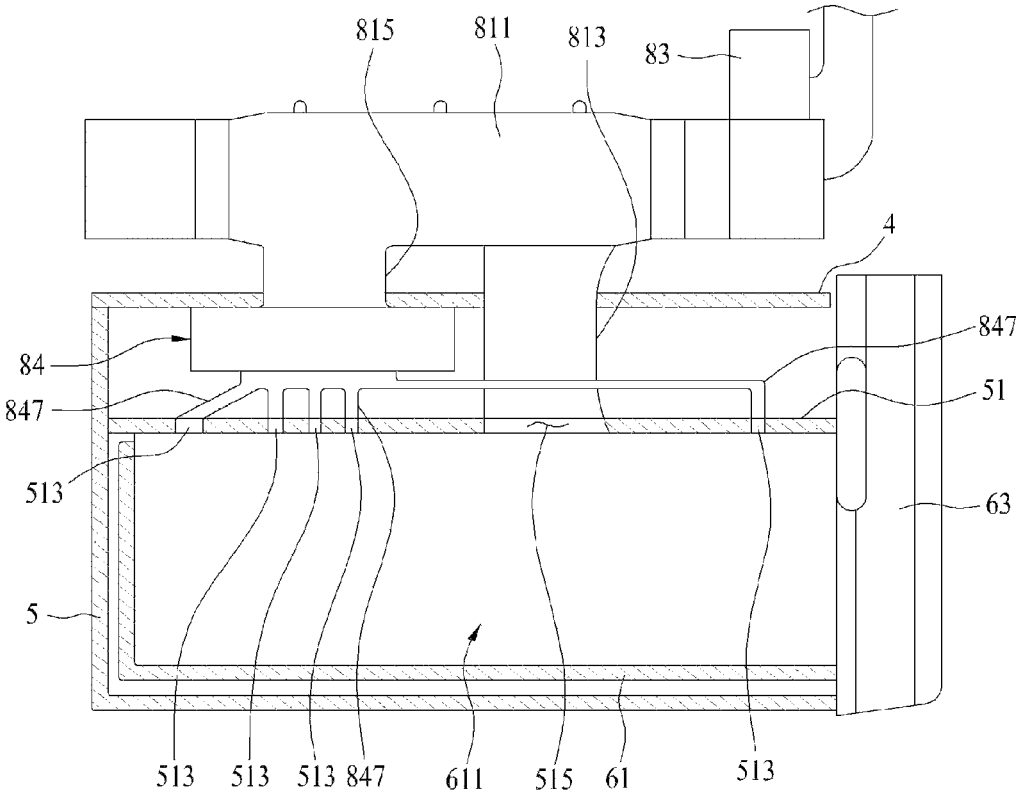

【Fi gure 7】
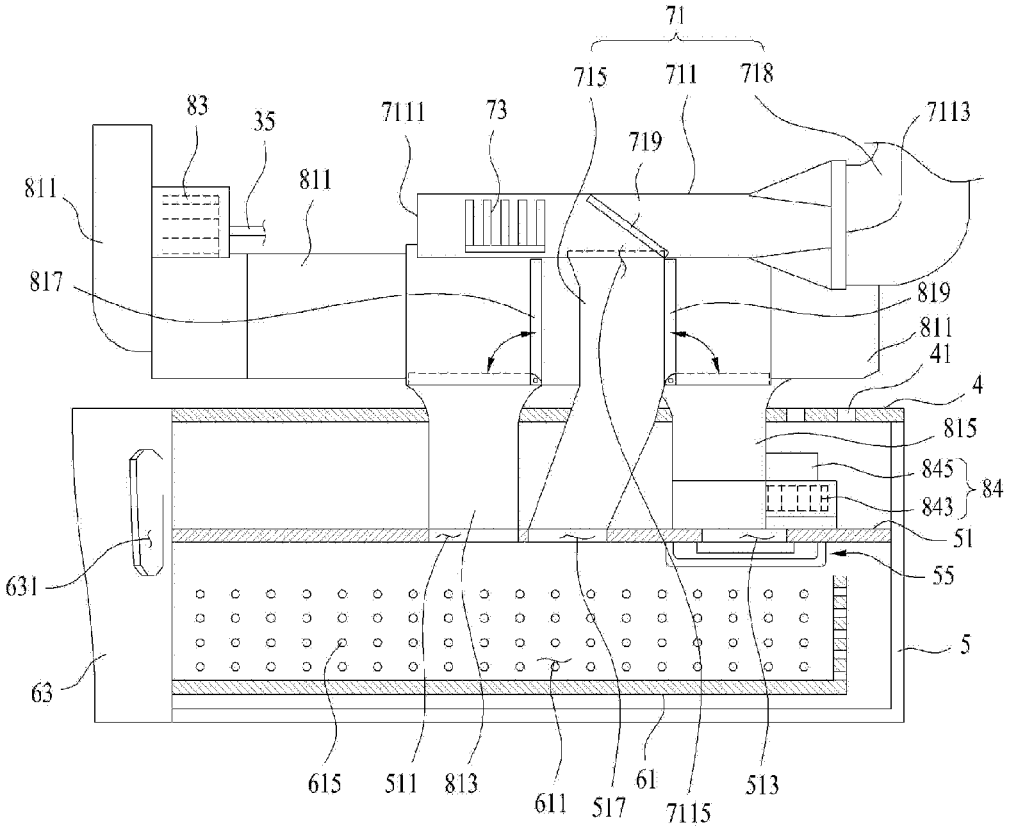

【Figure 8】
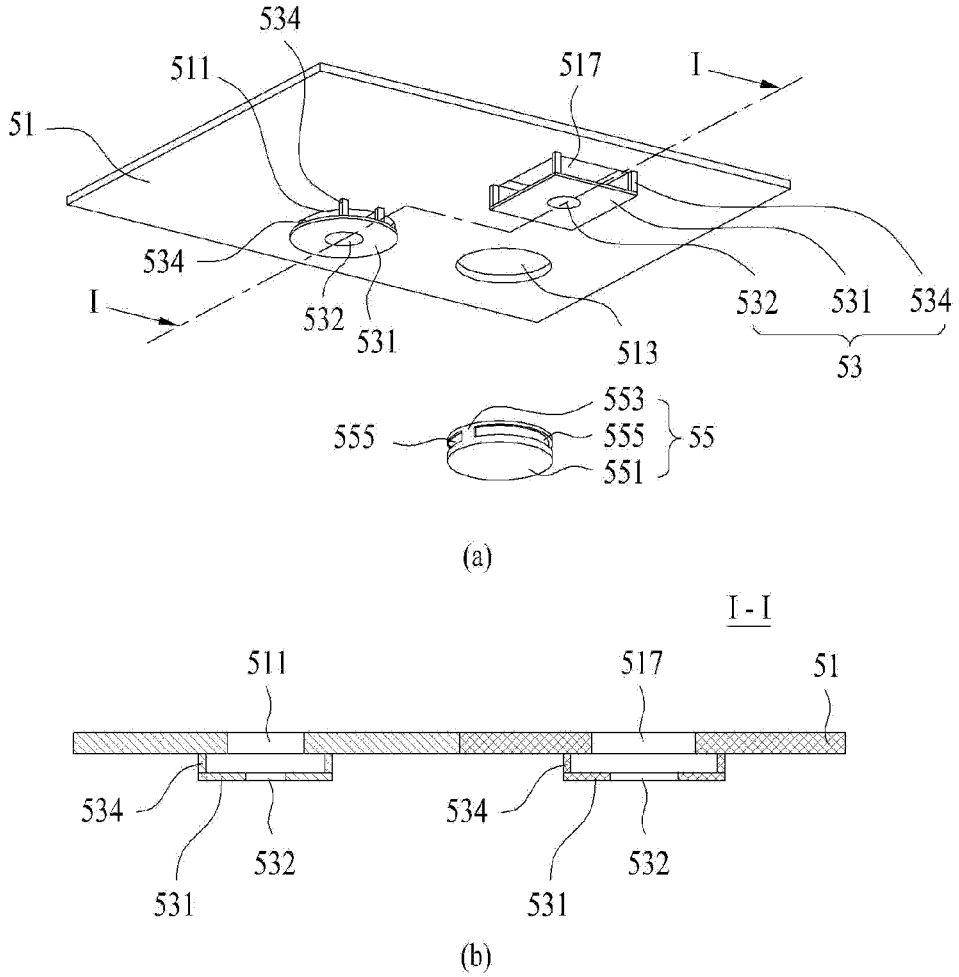

【Figure 9】
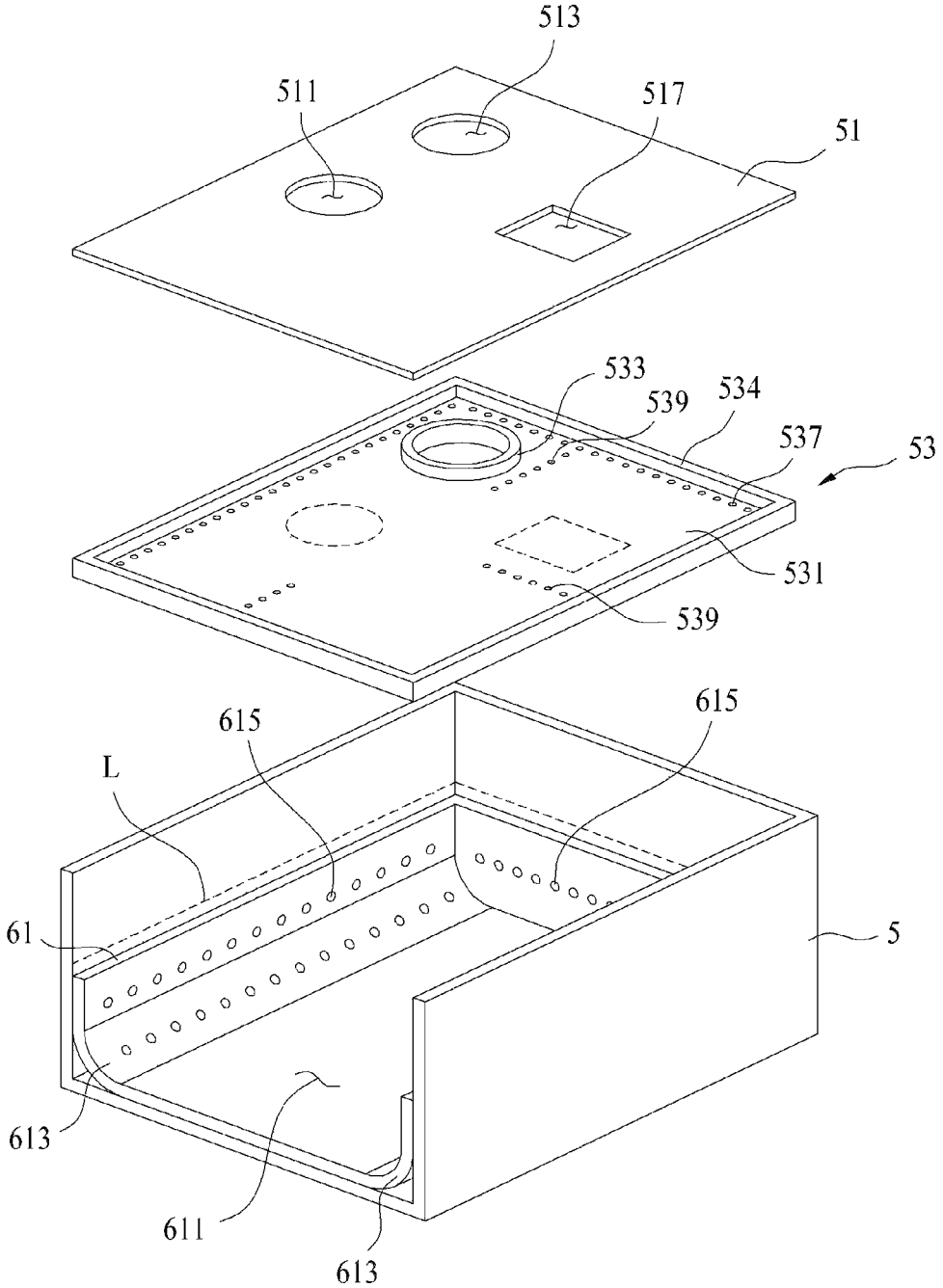

【Figure 10】
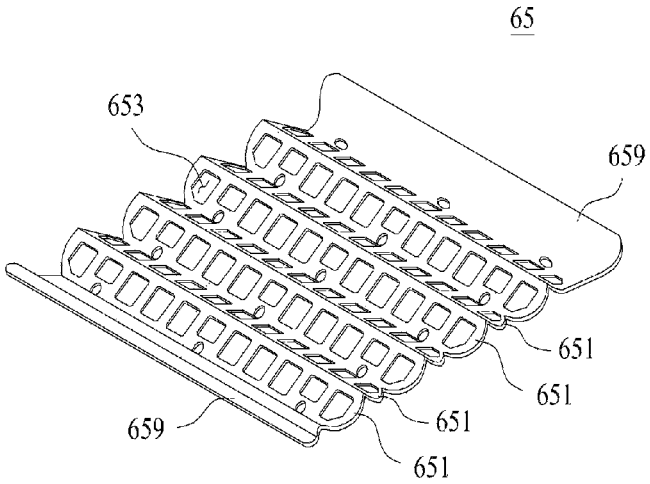
(a)
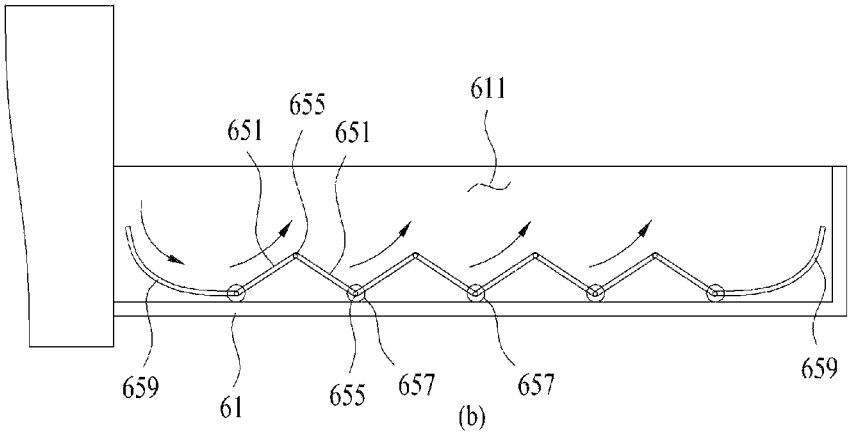
(b)

【Figure 11】
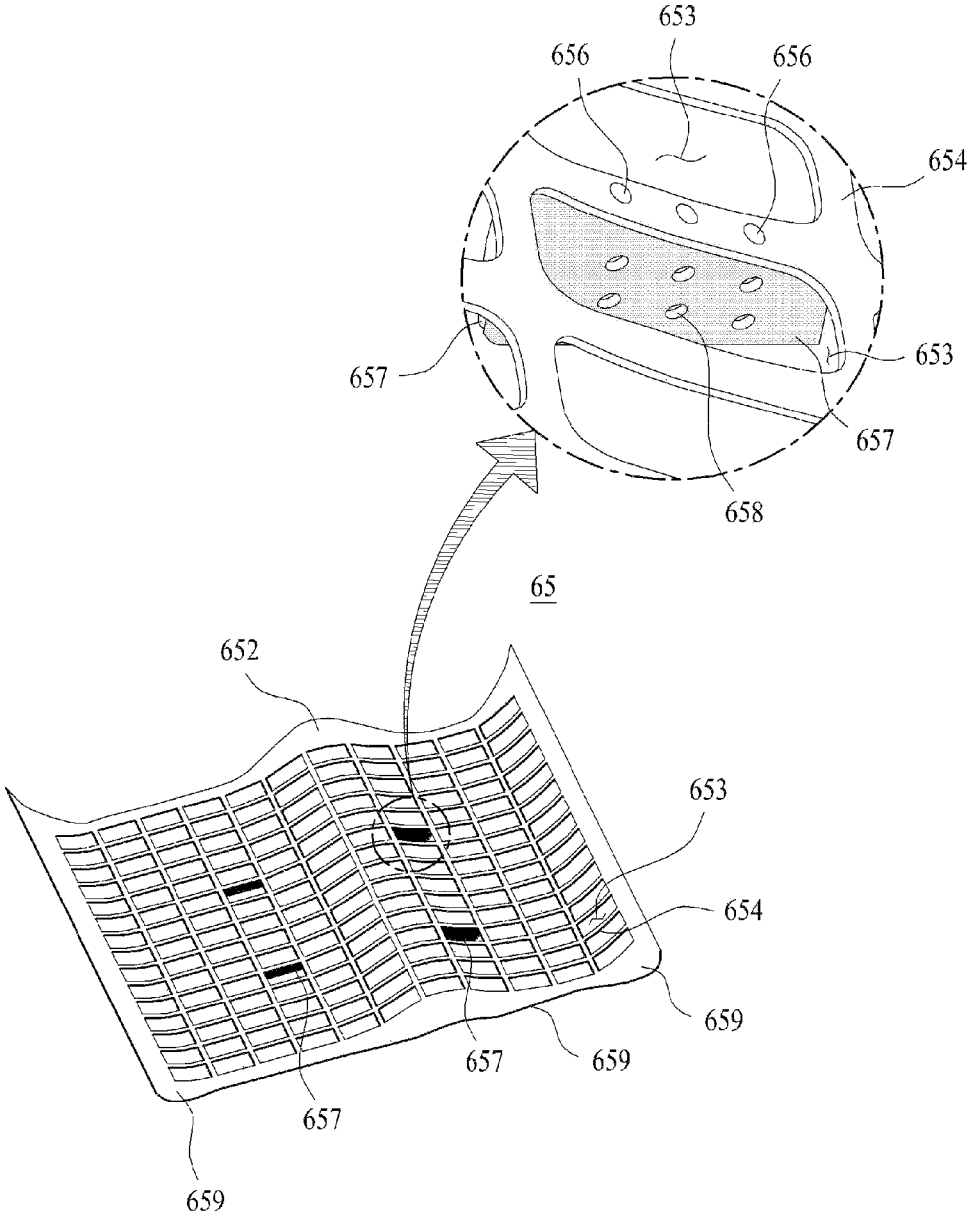

LAUNDRY TREATING APPARATUS

Pursuant to 35 U.S.C. §119(a), this application claims the benefit of Korean Patent Application No. 10-2013-0021851, filed on Feb. 28, 2013, which is hereby incorporated by reference as if fully set forth herein.

BACKGROUND OF THE INVENTION

Field of the Invention

The present invention relates to a laundry treating apparatus.

Discussion of the Related Art

A laundry treating apparatus is a home appliance hat is capable of washing and/or drying laundry (clothes). The laundry treating apparatus includes a washing machine, a drying machine, and a washing and drying machine.

A laundry treating apparatus that is capable of drying laundry supplies high-temperature air (hot air) to the laundry. Based on flow mode of air, the laundry treating apparatus may be classified as an exhaust type laundry treating apparatus or a circulation type (condensation type) laundry treating apparatus.

The circulation type laundry treating apparatus is configured to have a structure in which water is removed from air discharged from a receiving space (i.e. the air is dehumidified), the dehumidified air is heated, and the heated air is resupplied into the receiving space.

The exhaust type laundry treating apparatus is configured to have a structure in which heated air is supplied to a receiving space and air discharged from the receiving space is not resupplied into the receiving space but is exhausted out of the laundry treating apparatus.

Meanwhile, in a conventional laundry treating apparatus, a space to receive laundry is divided into a first receiving space and a second receiving space such that laundry is dried using any one selected from between the first receiving space and the second receiving space based on the amount of the laundry.

Such a laundry treating apparatus includes an exhaust fan to discharge air from the first receiving space. The exhaust fan is rotated by a drive unit to rotate the first receiving space. That is, the first receiving space and the exhaust fan are simultaneously rotated during rotation of the drive unit.

Meanwhile, the laundry treating apparatus as described above is configured such that air in the first receiving space passes through the second receiving space and is then discharged out of the laundry treating apparatus to supply air to both the first receiving space and the second receiving space. However, the laundry treating apparatus has the following problems.

Since the first receiving space and the exhaust fan are rotated by one drive unit, the first receiving space, in which laundry is not placed, is rotated even when air is supplied only to the second receiving space with the result that a user may think that the laundry treating apparatus malfunctions.

In addition, when only laundry stored in the second receiving space is dried, hot air is introduced into the second receiving space through the first receiving space with the result that drying efficiency is reduced (drying time is increased and temperature of hot air is decreased).

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that supplies air to a plurality of receiving spaces provided to dry laundry.

Another object of the present invention is to provide a laundry treating apparatus that is capable of simultaneously supply air to a plurality of receiving spaces in which laundry is received and selectively supplying air only to a specific one of the receiving spaces.

Another object of the present invention is to provide a laundry treating apparatus configured such that air blowing means to supply air to a plurality of receiving spaces are individually provided in the respective receiving spaces.

A further object of the present invention is to provide a laundry treating apparatus with high drying efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a first cabinet having a first receiving space to receive laundry, a second cabinet having a second receiving space to receive laundry, the second cabinet being separated from the first cabinet, a partition wall located at an upper part of the second receiving space to divide an interior of the second cabinet, a supply unit to selectively supply air to the first receiving space and the second receiving space, a discharge unit including an exhaust duct to discharge air in the first receiving space out of the first cabinet and a suction fan provided in the partition wall such that the suction fan is located in the second cabinet to suction air from the second receiving space such that the air from the second receiving space moves to the exhaust duct.

The exhaust duct may include a duct body provided in the first cabinet to allow the first receiving space to communicate with an outside of the first cabinet therethrough, a first connection channel connected between the duct body and the second receiving space to guide air from the duct body to the second receiving space, and a second connection channel connected between the duct body and the second receiving space, the suction fan being provided in the second connection channel.

The discharge unit may further include an exhaust fan provided in the duct body such that the exhaust fan is located between the first receiving space and the first connection channel to move air from the first receiving space to the duct body.

The discharge unit may further include a first exhaust damper to open any one selected from between the first connection channel and the duct body and a second exhaust damper to open any one selected from between the second connection channel and the duct body.

The discharge unit may further include a dehumidification unit located between the exhaust fan and the first connection channel to dehumidify air discharged from the first receiving space.

The laundry treating apparatus may further include a drive unit having a first rotary shaft to rotate the first receiving space and a second rotary shaft to rotate the exhaust fan.

The supply unit may include a heating channel provided in the first cabinet to heat air, the heating channel having a first discharge port and a second discharge port to discharge the heated air, a first supply channel connected between the first discharge port and the first receiving space, a second supply channel to allow the second discharge port and the second receiving space to communicate with each other therethrough, and a supply damper to selectively open the first discharge port and the second discharge port.

The partition wall may include a first connection channel fixing hole to allow the first connection channel to communicate with the second receiving space therethrough, a second connection channel fixing hole to allow the suction fan to communicate with the second receiving space therethrough, and a supply channel fixing hole to allow the second supply channel to communicate with the second receiving space therethrough.

The laundry treating apparatus may further include an introduction preventing unit located below the second connection channel fixing hole to prevent laundry in the second receiving space from being introduced into the suction fan.

The second connection channel fixing hole may include a plurality of second connection channel fixing holes provided at the partition wall, and the discharge unit may further include a fan supply channel connected between the second connection channel fixing holes and the suction fan.

The second connection channel fixing holes may include at least one selected from between a plurality of holes provided along an edge of the partition wall and a plurality of holes arranged from the edge of the partition wall toward a middle of the partition wall.

The laundry treating apparatus may further include a diffusion unit provided below the partition wall to diffuse air introduced into the second receiving space through at least one selected from between the first connection channel and the second supply channel in the second receiving space.

The diffusion unit may include a diffusion plate provided below the first connection channel fixing hole and a plurality of spacers provided along an outer circumference of the diffusion plate at intervals such that the diffusion plate is spaced apart from the first connection channel fixing hole by a predetermined distance.

The diffusion unit may include a diffusion plate provided below the supply channel fixing hole and a plurality of spacers provided along an outer circumference of the diffusion plate at intervals such that the diffusion plate is spaced apart from the supply channel fixing hole by a predetermined distance.

The diffusion unit may include a diffusion plate provided below the partition wall, a spacer provided to surround the first connection channel fixing hole, the second connection channel fixing hole, and the supply channel fixing hole such that the diffusion plate is spaced apart from the partition wall by a predetermined distance, a connection channel connection pipe formed through the diffusion plate such that the connection channel connection pipe is connected to the second connection channel fixing hole, and a plurality of supply holes formed through the diffusion plate.

The supply holes may include at least one selected from between a plurality of first supply holes provided along a edge of the diffusion plate and a plurality of second supply holes arranged from the edge of the diffusion plate toward a middle of the diffusion plate.

The second cabinet may be provided below the first cabinet to support the first cabinet, and the second receiving space may include a drawer configured to be drawn from the second cabinet.

The drawer may be provided with a rack to space laundry from a bottom of the drawer by a predetermined distance, and the rack may include a rack body provided in the drawer, a protruding part protruding from the rack body toward at least one selected from between the second connection channel fixing hole and the supply channel fixing hole, a plurality of rack body through holes formed through the rack body, and a body support part provided at the rack body to space the rack body from a bottom of the drawer by a predetermined distance.

The rack may include a rib to divide the rack body through holes from each other, a rib through hole formed through the rib such that an upper side of the rack body communicates with a lower side of the rack body through the rib through hole, and a support part through hole formed through the body support part.

The rack may further include a rack inclined part provided at an edge of the rack body such that the rack inclined part is at an angle to the partition wall, and the drawer may further include an inclined part provided at an edge of the drawer such that the inclined part is at an angle to the partition wall, the inclined part being perpendicular to the rack inclined part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 1 and 2 are views showing a laundry treating apparatus according to an embodiment of the present invention;

FIG. 3 is a view showing a second cabinet, a supply unit, and a discharge unit included in the laundry treating apparatus according to the embodiment of the present invention;

FIG. 4 is a view showing a cabinet wall, a partition wall, a drawer, and the second cabinet included in the laundry treating apparatus according to the embodiment of the present invention;

FIGS. 5 and 6 are views showing the discharge unit included in the laundry treating apparatus according to the embodiment of the present invention;

FIG. 7 is a view showing the discharge unit and the supply unit included in the laundry treating apparatus according to the embodiment of the present invention;

FIGS. 8 and 9 are views showing a diffusion unit included in the laundry treating apparatus according to the embodiment of the present invention; and FIGS. 10 and 11 are views showing a rack included in the laundry treating apparatus according to the embodiment of the present invention.

DETAILED DESCRIPTION OF THE INVENTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

As shown in FIG. 1, a laundry treating apparatus 100 according to an embodiment of the present invention includes a first cabinet 1 having a first receiving space to receive laundry (laundry to be washed or laundry to be dried) and a second cabinet 5 having a second receiving space to receive laundry, the second cabinet 5 being separated from the first cabinet 1.

As shown in FIG. 2, a laundry introduction port 11, through which laundry is introduced into and removed from the first cabinet 1, is provided at a front panel of the first cabinet 1. The laundry introduction port 11 is opened and closed by a door 15 hinged to the first cabinet 1.

Meanwhile, an outside air introduction port 12 and an discharge port 13, through which the inside of the first cabinet 1 communicates with the outside of the first cabinet 1, may be provided at a rear panel of the first cabinet 1.

The outside air introduction port 12 is a means to allow outside air to be introduced into the first cabinet 1 therethrough and the discharge port 13 is a means to allow air flowing along a duct body 811 to be discharged from the first cabinet 1 therethrough.

In a case in which the laundry treating apparatus 100 according to the embodiment of the present invention is used only to dry laundry, the first receiving space may include a drum 2 rotatably disposed in the first cabinet 1.

The drum 2 may be formed in a cylindrical shape opened at the front and rear thereof. In this case, a front support unit 17 and a rear support unit 19 to rotatably support the drum 2 may be further provided in the first cabinet 1.

The front support unit 17 may include a support unit body 171 fixed in the first cabinet 1, a body through hole 173 formed through the support unit body 171, and a front flange 175 provided at the support unit body 171 to support the front of the drum 2.

The body through hole 173 is provided to communicate with the laundry introduction port 11. Consequently, laundry introduced through the laundry introduction port 11 may move into the drum 2 through the body through hole 173.

The body through hole 173 is provided with a hollow guide pipe 1731 extending toward the door 15. In this case, the guide pipe 1731 may be connected between the front panel and the support unit body 171 to surround the circumference of the body through hole 173 and the circumference of the laundry introduction port 11.

Meanwhile, in a case in which the door 15 is at an angle to the front panel of the first cabinet 1, the length of the guide pipe 1731 located at the lower part of the door 15 may be greater than that of the guide pipe 1731 located at the upper part of the door 15.

The front flange 175 may be provided along the circumference of the body through hole 173 such that the front flange 175 protrudes from the surface of the support unit body 171 toward the drum 2. The front inner circumference of the drum 2 is supported by the outer circumference of the front flange 175.

Furthermore, the front support unit 17 is further provided with a discharge unit connection hole 177, into which a discharge unit 8, which will be described hereinafter, is coupled. The discharge unit connection hole 177 is formed through the guide pipe 1731 such that the inside of the drum 2 communicates with the outside of the drum 2.

The rear support unit 19 may include a support unit body 191 fixed in the first cabinet 1 and a rear flange 193 provided at the support unit body 191 to rotatably support the rear of the drum 2.

The rear support unit 19 is further provided with a supply unit connection hole 195, into which a supply unit 7, which will be described hereinafter, is coupled. The supply unit connection hole 195 is formed through the support unit body 191 such that the inside of the drum 2 communicates with the outside of the drum 2.

On the other hand, in a case in which the laundry treating apparatus 100 according to the embodiment of the present invention is used to dry and wash laundry, the first receiving space may include a tub (not shown) provided in the first cabinet 1 to contain wash water and a drum 2 rotatably coupled in the tub.

In this case, the front support unit and the rear support unit may be omitted. In addition, the body through hole 173, the guide pipe 1731, and the discharge unit connection hole 177 may be provided at the front of the tub, which is formed in a cylindrical shape, and the supply unit connection hole 195 may be provided at the rear of the tub. The drum 2 may be rotatably supported in the tub by a rotary shaft extending through the rear of the tub. In addition, a plurality of through holes, through which the tub communicates with the drum, may be provided at the outer circumference of the drum 2.

Hereinafter, the laundry treating apparatus 100 that is capable of only drying laundry will be described for the convenience of description.

The drum 2 is rotated by a drive unit 3. The drive unit 3 may include a drum motor 31 provided at the first cabinet 1, a first rotary shaft 33 and a second rotary shaft 35 rotated by the drum motor 31, and a belt 37 connected between the circumference of the drum 2 and the first rotary shaft 33.

The second rotary shaft 35 is connected to an exhaust fan 83 through the duct body 811. In the laundry treating apparatus 100 according to the embodiment of the present invention, therefore, it is possible to simultaneously rotate the drum 2 and the exhaust fan 83 using one drum motor 31.

The second cabinet 5 is located below the first cabinet 1 to not only serve as a pedestal to support the first cabinet 1 but also dry laundry received in the second receiving space.

The second cabinet 5 is separated from the first cabinet 1 by a cabinet wall 4. In a case in which the first cabinet 1 is formed in a shape opened at the bottom thereof and the second cabinet 5 is formed in a shape opened at the top thereof, the cabinet wall 4 may not only define the bottom of the first cabinet 1 but also define the top of the second cabinet 5.

The second cabinet 5 may be formed in a hexahedral shape opened at the front thereof. The interior of the second cabinet 5 is divided into an upper space and a lower space by a partition wall 51.

The second receiving space is provided a space below the partition wall 51 (a space defined between the partition wall 51 and the second cabinet 5). The second receiving space may include a drawer 6 that can be drawn from the second cabinet 4.

A space above the partition wall 51 (a space defined between the partition wall 51 and the cabinet wall 4) may include a machinery compartment M to receive devices necessary to dry laundry stored in the drawer 6.

The drawer 6 may include a drawer body 61 located at the space below the partition wall 51 to receive laundry and a drawer panel 63 located at the open front of the second cabinet 5 to draw the drawer body 61 from the second cabinet 5.

The drawer body 61 may be formed in a hexahedral shape opened at the top thereof to serve as a laundry receiving space 611. The drawer panel 63 may be provided with a handle 631 to draw the drawer body 61.

Meanwhile, as shown in FIG. 3, the laundry treating apparatus 100 according to the embodiment of the present invention further includes a supply unit 7 to selectively supply air to the drum (first receiving space) 2 and the drawer (second receiving space) 6 and a discharge unit 8 having an exhaust fan 83 and a suction fan 84 to selectively discharge air from the drum 2 and the drawer 6.

The discharge unit 8 includes an exhaust duct 81 provided in the first cabinet 1. The exhaust duct 81 discharges air in the drum 2 out of the laundry treating apparatus 100. In addition, the exhaust duct 81 exhausts air discharged from the drum 2 out of the laundry treating apparatus 100 via the drawer body 61.

To this end, the exhaust duct 81 may include a duct body 811 located in the first cabinet 1 such that the discharge unit connection hole 177 and the discharge port 13 are connected to each other through the duct body 811 and a first connection channel 813 and a second connection channel 815 extending through the cabinet wall 4 such that the duct body 811 communicates with the interior of the drawer body 61.

In this case, the exhaust fan 83 is provided in the duct body 811 such that the exhaust fan 83 is located between the discharge unit connection hole 177 and the first connection channel 813. The suction fan 84 is provided in the second connection channel 815.

The exhaust fan 83 is rotated by a second rotary shaft 35 (see FIG. 2) of the drum motor 31 extending through the duct body 811. During operation of the drum motor 31, therefore, air in the drum 2 may introduced into the duct body 811.

Meanwhile, as shown in FIG. 4, the partition wall 51 is provided with a first connection channel fixing hole 511, a second connection channel fixing hole 513, and a supply channel fixing hole 517, in which a second supply channel 715 provided in the supply unit is fixed.

The first connection channel fixing hole 511, the second connection channel fixing hole 513, and the supply channel fixing hole 517 are formed through the partition wall 51. Consequently, the laundry receiving space 611 of the drawer 6 communicates with the space above the partition wall 51 through the above fixing holes, which will hereinafter be described in detail.

When the first connection channel 813 and the second connection channel 815 are respectively fixed in the first connection channel fixing hole 511 and the second connection channel fixing hole 513 through the cabinet wall 4, therefore, the laundry receiving space 611 of the drawer 6 communicates with the duct body 811.

In this case, as shown in FIG. 5, the suction fan 84 is provided in the second connection channel 815. The suction fan 84 may include a blade 843 located above the second connection channel fixing hole 513 and a fan motor 845 provided in the machinery compartment M to rotate the blade 843.

In the laundry treating apparatus 100 according to the embodiment of the present invention, therefore, a controller (not shown) independently control the exhaust fan 83 and the suction fan 84. Consequently, it is possible to prevent the drum 2 from being rotated when air is supplied only to the drawer 6, which will hereinafter be described in detail.

Meanwhile, a plurality of second connection channel fixing holes 513 may be provided at the partition wall 51.

In a case in which a plurality of second connection channel fixing holes 513 is provided at the partition wall 51, as shown in FIG. 6, the discharge unit 8 may further include a plurality of fan supply channels 847 to guide air discharged from the respective second connection channel fixing holes 513 to the suction fan 84.

In particular, the second connection channel fixing holes 513 may be a plurality of holes provided along the edge of the partition wall 51 or a plurality of holes arranged from the edge of the partition wall 51 toward the middle of the partition wall 51.

Alternatively, the second connection channel fixing holes 513 may include a plurality of holes provided along the edge of the partition wall 51 and a plurality of holes arranged from the edge of the partition wall 51 toward the middle of the partition wall 51.

Consequently, air in the drawer 6 may be easily discharged to the duct body 811 through the suction fan 84, thereby improving drying efficiency of the laundry stored in the drawer 6.

Meanwhile, as shown in FIG. 5, the exhaust duct 81 may further include a first exhaust damper 817 provided to open any one selected from between the first connection channel 813 and the duct body 811 and a second exhaust damper 819 provided to open any one selected from between the second connection channel 815 and the duct body 811.

The first exhaust damper 817 and the second exhaust damper 819 are hinged to the duct body 811. The first exhaust damper 817 opens any one selected from between the first connection channel 813 and the duct body 811 according to a control signal of the controller (not shown). On the other hand, the second exhaust damper 819 opens any one selected from between the second connection channel 815 and the duct body 811 according to a control signal of the controller (not shown).

As shown in FIG. 7, the supply unit 7 includes a supply duct 71 provided in the first cabinet 1 to supply air (heated air or unheated air) to the drum (first receiving space) 2 and the drawer (second receiving space) 6.

In a case in which the supply unit 7 is provided to supply heated air (hot air) to the drum 2 or the drawer 6, a heater 73 is further provided in the supply duct 71.

That is, the supply duct 71 includes a heating channel 711, provided in the first cabinet 1, in which the heater 73 is fixed, a drum supply channel (first supply channel) 718 connected between the heating channel 711 and the drum 2, and a drawer supply channel (second supply channel) 715 connected between the heating channel 711 and the drawer 6.

The heating channel 711 includes an open side 7111, through which air is introduced from the first cabinet 1, and a first discharge port 7113 and a second discharge port 7115 to discharge the air introduced through the open side 7111.

In this case, the drum supply channel 718 is connected between the first discharge port 7113 and the supply unit connection hole 195 (see FIG. 1) to supply air having passed through the heating channel 711 to the drum 2.

In addition, the drawer supply channel 715 is formed through the cabinet wall 4 such that the second discharge port 7115 and the supply channel fixing hole 517 are connected to each other through the drawer supply channel 715.

Consequently, air in the heating channel 711 may be supplied into the drawer 6 through the drawer supply channel 715.

Meanwhile, the supply duct 71 is provided with a supply damper 719 to open any one selected from between the first discharge port 7113 and the second discharge port 7115.

The supply damper 719 is hinged to any one selected from between the heating channel 711 and the drawer supply channel (second supply channel) 715 to open any one selected from between the drum supply channel 718 and the drawer supply channel 715 according to a control signal of the controller (not shown).

In this case, the controller (not shown) may control the supply damper 719 to be rotated to a position at which the first discharge port 7113 and the second discharge port 7115 are simultaneously opened.

Hereinafter, operation of the laundry treating apparatus 100 with the above-stated construction according to the embodiment of the present invention will be described with reference to FIG. 7.

In a case in which hot air is supplied only to the drum 2, the first exhaust damper 817 closes the first connection channel 813 according to a control signal of the controller (not shown) and the second exhaust damper 819 closes the second connection channel 815 according to a control signal of the controller (not shown).

In addition, the controller (not shown) controls the supply damper 719 to close the drawer supply channel (second supply channel) 715 and to open the drum supply channel 718 (to open the first discharge port 7113 and to close the second discharge port 7115).

In this state, the controller (not shown) controls the drum motor 31 to be driven such that the drum 2 and the exhaust fan 83 are rotated by the drum motor 31.

When the exhaust fan 83 is rotated by the drum motor 31, air in the drum 2 is discharged out of the first cabinet 1 through the duct body 811 with the result that atmospheric pressure in the drum 2 is lowered.

Since the atmospheric pressure in the drum 2 is lowered, air in the first cabinet 1 is supplied to the drum 2 through the open side 7111, the heating channel 711, and the drum supply channel 718. When the heater 73 is driven while the air passes through the heating channel 711, hot air may be supplied to the drum 2.

The drum 2 is rotated by the belt 37 while the air is supplied to the drum 2. Consequently, laundry received in the drum 2 may easily exchange heat with the air.

Meanwhile, air is continuously supplied to the heater 73 through the outside air introduction port 12 provided at the first cabinet 1 and the open side 7111 provided at the drawer exhaust channel 713.

In a case in which hot air is supplied simultaneously to the drum 2 and the drawer 6, the first exhaust damper 817 opens the first connection channel 813 according to a control signal of the controller (not shown) and the second exhaust damper 819 opens the second connection channel 815 according to a control signal of the controller (not shown).

In addition, the controller (not shown) controls the supply damper 719 to close the drawer supply channel 715 and to open the drum supply channel 718.

In this state, the controller (not shown) controls the drum motor 31 to be driven such that the drum 2 and the exhaust fan 83 are rotated by the drum motor 31.

When the exhaust fan 83 is rotated by the drum motor 31, air in the drum 2 is introduced into the duct body 811 and then supplied to the laundry receiving space 611 of the drawer 6 through the first connection channel 813 and air introduced into the laundry receiving space 611 of the drawer 6 is discharged out of the first cabinet 1 through the second connection channel 815.

Since atmospheric pressure in the drum 2 is lowered as the air is discharged from the drum 2, air in the first cabinet 1 is supplied to the drum 2 through the heating channel 711 and the drum supply channel 718. When the heater 73 is driven while the air passes through the heating channel 711, hot air may be supplied to the drum 2 and the drawer 6.

Furthermore, the second connection channel 815 included in the laundry treating apparatus 100 according to the embodiment of the present invention may be configured such that the sectional area of the second connection channel 815 gradually increases from the duct body 811 toward the partition wall 51 to easily discharge air from the drawer 6.

Meanwhile, in a case in which air is supplied simultaneously to the drum 2 and the drawer 6, humidity of air to be supplied to the drawer 6 is high because the air has already exchanged heat with the laundry stored in the drum 2.

When the humidity of air to be supplied to the drawer 6 is high, time necessary to dry the laundry stored in the drawer 6 may be increased. For this reason, the laundry treating apparatus 100 according to the embodiment of the present invention may further include a dehumidification unit 85 provided in the duct body 811 to dehumidify air.

As shown in FIG. 5(*b*), the dehumidification unit 85 may include a housing 851 provided in the duct body 811 such that the housing 851 is disposed between the discharge unit connection hole 177 and the first connection channel 813 and a dehumidifying agent (drying agent) 853 rotatably provided in the housing to dehumidify air introduced into the duct body 811.

The dehumidification unit 85 may further include a first through hole 8511 formed through the housing 851 such that the first through hole 8511 is located in the duct body 811 and a second through hole 8513 formed through the housing 851 such that the second through hole 8513 is located outside the duct body 811.

The dehumidifying agent 853 is rotatably fixed in the housing 851 through a rotary shaft 855. Air in the duct body 811 passes through the dehumidifying agent 853 through the first through hole 8511. Air in the first cabinet 1 comes into contact with the dehumidifying agent 853 through the second through hole 8513.

The dehumidifying agent 853 may be rotated in the housing 851 by a belt 857 connected between a rotary shaft of a motor 856 and the outer circumference of the dehumidifying agent 853 such that the dehumidifying agent 853 is reproduced by a heater 858 and a fan 859 to supply hot air to the second through hole 8513.

That is, the dehumidifying agent 853, which is located in the first through hole 8511 to absorb water from air flowing in the duct body 811, is moved to the second through hole 8513 by the motor 856 and the belt 857 and the water absorbed by the dehumidifying agent 853 is removed by the 858 and the fan 859 to supply hot air to the second through hole 8513.

In a case in which hot air is supplied only to the drawer 6, as shown in FIG. 7, the supply damper 719 opens the drawer supply channel 715 and closes the drum supply channel 718 according to a control signal of the controller (not shown). At this time, the second exhaust damper 819 opens the second connection channel 815.

In this state, the controller (not shown) controls the fan motor 845 to be rotated (the drum motor 31 is not rotated).

When the fan motor 845 is rotated, air in the laundry receiving space 611 of the drawer 6 is discharged out of the laundry treating apparatus 100 through the second connection channel 815 and the duct body 811 by the blade 843.

When the air in the laundry receiving space 611 of the drawer 6 is discharged out of the laundry treating apparatus 100, atmospheric pressure in the laundry receiving space 611 of the drawer 6 is lowered. As a result, air in the first cabinet 1 is supplied to the laundry receiving space 611 of the drawer 6 through the heating channel 711 and the drawer supply channel 715.

When the heater 73 is driven while the air passes through the heating channel 711, hot air may be supplied to the laundry receiving space 611 of the drawer 6.

Meanwhile, wall through holes 41 may be provided at the cabinet wall 4 such that air is continuously supplied to the laundry receiving space 611 of the drawer 6.

Furthermore, in a structure in which the space above the partition wall 51 and the interior of the drawer 6 are hermetically sealed by the partition wall 51, partition wall through holes (not shown) may also be provided at the partition wall 51.

In a case in which air is supplied only to the drawer 6, control of the first exhaust damper 817 is not particularly restricted. That is, in the laundry treating apparatus 100 according to the embodiment of the present invention, air in the drawer 6 is discharged out of the laundry treating apparatus 100 through the suction fan 84. Even in a state in which the first exhaust damper 817 opens the first connection channel 813, therefore, there is a low possibility that air introduced into the laundry receiving space 611 of the drawer 6 will move to the drum 2.

If some of the air introduced into the laundry receiving space 611 of the drawer 6 moves to the drum 2, however, the air may condense on the inner circumference of the drum 2. For this reason, in a case in which air is supplied only to the drawer 6, the first exhaust damper 817 closes the first connection channel 813.

The reason that the laundry treating apparatus 100 according to the embodiment of the present invention further includes the suction fan 84 controlled independent of the exhaust fan 83 is that it is necessary to prevent rotation of the drum 2 when air is supplied only to the drawer 6.

That is, in the laundry treating apparatus 100 according to the embodiment of the present invention, the exhaust fan 83 and the respective dampers 719, 817, and 819 may be controlled to supply air to laundry stored in the drawer 6 without the provision of the suction fan 84 (in a case in which air is supplied simultaneously to the drum 2 and the drawer 6).

In a case in which laundry is stored only in the drawer 6, however, the drum 2 may be rotated and hot air may be supplied to the drum 2 although no laundry is received in the drum 2 if the suction fan 84 is not provided.

Furthermore, since the drum 2 is rotated although the laundry treating apparatus 100 is operated only to dry the laundry stored in the drawer 6, a user may think that the laundry treating apparatus 100 may malfunction.

The suction fan 84 included in the laundry treating apparatus 100 according to the embodiment of the present invention solves the above problem.

Meanwhile, since, in the laundry treating apparatus 100 according to the embodiment of the present invention, air in the laundry receiving space 611 of the drawer 6 is discharged out of the laundry treating apparatus 100 through the suction fan 84, laundry in the drawer 6 may be introduced into the suction fan 84 through the second connection channel fixing hole 513.

For this reason, the partition wall 51 may further be provided with an introduction preventing unit 55 to prevent laundry from being introduced into the suction fan 84.

As shown in FIG. 8, the introduction preventing unit 55 may include a preventing unit body 551 fixed to the partition wall 51 such that the preventing unit body 551 is located below the second connection channel fixing hole 513, a preventing unit flange 553 connected between the preventing unit body 551 and the partition wall 51, and a flange through hole 555 formed through the preventing unit flange 553.

In this case, the preventing unit flange 553 may be provided to surround the second connection channel fixing hole 513 such that the preventing unit body 551 is spaced apart from the partition wall 51 by a predetermined distance.

Alternatively, the introduction preventing unit 55 may be fixed to the second connection channel 815 or the suction fan 84 such that the introduction preventing unit 55 is fit in the second connection channel fixing hole 513.

In addition, the laundry treating apparatus 100 according to the embodiment of the present invention may further include at least one diffusion unit 53 to diffuse air supplied to the drawer 6 through the drawer supply channel (second supply channel) 715 and the first connection channel 813 in the drawer 6.

The at least one diffusion unit 53 may be configured to have a form shown in FIG. 8 or 9.

The diffusion units 53 shown in FIG. 8 are provided at the bottom of the partition wall 51 such that the diffusion units 53 are located below the first connection channel fixing hole 511 and the supply channel fixing hole 517.

In this embodiment, each diffusion unit 53 may include a diffusion plate 531 located below the partition wall 51 (below the first connection channel fixing hole 511 or the supply channel fixing hole 517) and a plurality of spacers 534 provided along the outer circumference of the diffusion plate 531 at predetermined intervals such that the diffusion plate 531 is spaced apart from the partition wall 51 by a predetermined distance.

Consequently, air introduced into the drawer 6 through the first connection channel fixing hole 511 or the supply channel fixing hole 517 collides with the diffusion plate 531 and is diffused into the laundry receiving space 611 of the drawer 6 through spaces defined between the respective spacers 534. As a result, the laundry received in the drawer 6 may be more easily dried.

In this embodiment, each diffusion unit 53 may further include at least one supply hole 532 formed through the diffusion plate 531.

The diffusion unit 53 shown in FIG. 9 is configured to have a structure in which air introduced into the drawer 6 through the first connection channel fixing hole 511 and the supply channel fixing hole 517 is uniformly diffused in the laundry receiving space 611 of the drawer 6 through one diffusion plate 531.

That is, in this embodiment, the diffusion unit 53 may include a diffusion plate 531 disposed below the partition wall 51, a spacer 534 to fix the diffusion plate 531 to the bottom of the partition wall 51, a connection channel connection pipe 533 formed through the diffusion plate 531 such that the connection channel connection pipe 533 is fitted in the second connection channel fixing hole 513, and a plurality of supply holes 537 and 539 formed through the diffusion plate 531.

The diffusion plate 531 may have the same width as the partition wall 51 or a width sufficient to receive all the fixing holes 511, 513, and 517. The diffusion plate 531 fixed to the partition wall 51 is located (L) in the second cabinet 5 such that the diffusion plate 531 does not interfere with the drawer body 61.

In this case, the spacer 534 extends along the outer circumference of the diffusion plate 531 to surround the respective fixing holes 511, 513, and 517 such that the diffusion plate 531 is spaced apart from the partition wall 51 by a predetermined distance.

The supply holes 537 and 539 may include a plurality of first supply holes 537 provided along the edge of the diffusion plate 531 and a plurality of second supply holes 539 arranged from the edge of the diffusion plate 531 toward the middle of the diffusion plate 531.

Air discharged from the drawer 6 through the second connection channel 815 is prevented from leaking to a space defined between the partition wall 51 and the diffusion plate 531 by the connection channel connection pipe 533.

In addition, air discharged from the first connection channel 813 and the drawer supply channel 715 collides with the diffusion plate 531 and is then introduced into the drawer 6 through the supply holes 537 and 539. In the laundry treating apparatus 100 according to the embodiment of the present invention, therefore, it is possible to more easily dry the laundry received in the drawer 6.

In order to easily achieve heat exchange between the air introduced into the drawer 6 and the laundry received in the drawer 6, the drawer body 61 may be further provided with at least one selected from between inclined parts 613 and a plurality of drawer through holes 615.

The inclined parts 613 may be provided at only opposite corners provided in the longitudinal direction of the drawer body 61. Alternatively, the inclined parts 613 may be provided at all corners.

Consequently, the air introduced into the drawer body 61 moves toward the middle of the drawer body 61, in which the laundry is placed, along the inclined parts 613 to exchange heat with the laundry.

The drawer through holes 615 are formed through the drawer body 61.

Consequently, some of the air introduced into the laundry receiving space 611 of the drawer 6 by the exhaust fan 83 may be discharged from the laundry receiving space 611 of the drawer 6 and move along a space defined between the drawer body 61 and the second cabinet 5. Since the air moving along a space defined between the drawer body 61 and the second cabinet 5 is reintroduced into the laundry receiving space 611 of the drawer 6 through the drawer through holes 615, it is possible to prevent reduction of drying efficiency even in a case in which the laundry accumulates only at a portion of the laundry receiving space 611 of the drawer 6.

Meanwhile, during operation of the suction fan 84, air between the drawer body 61 and the second cabinet 5 is introduced into the laundry receiving space 611 of the drawer 6 through the drawer through holes 615 and is then discharged through the second connection channel 815. Consequently, it is possible to prevent reduction of drying efficiency through the provision of the drawer through holes 615 even in a case in which the laundry accumulates only at a portion of the laundry receiving space 611 of the drawer 6.

The drawer through holes 615 may be provided over the entire region of the drawer body 61 or only at the side wall of the drawer body 61.

The laundry treating apparatus 100 according to the embodiment of the present invention may further include a rack 65 provided in the laundry receiving space 611 of the drawer 6 to prevent contact between the laundry and the bottom of the drawer body 61.

The rack 65 may be configured to have a folded type structure as shown in FIG. 10.

In this case, the rack 65 may include a plurality of rack bodies 651 located in the drawer body 61 to support laundry, a plurality of rack body connection shafts 655 to interconnect the respective rack bodies 651, and a plurality of body support parts (wheels) 657 provided at the respective rack body connection shafts 655 to space the rack bodies 651 from the bottom of the drawer body 61 by a predetermined distance.

The total length of the rack bodies 651 is greater than the length of the drawer body 61 and the rack body connection shafts 655 having no body support parts 657 (a coupling part between each rack body 651 and an adjacent rack body 651) protrude toward the partition wall 51. Consequently, the respective rack bodies 651 are inclined.

In this case, the first connection channel 813 may be further provided with a guider 8131 (see FIG. 5) to guide air to the front (one surface of the drawer body 61 located in a direction in which the drawer panel 63 is provided) or the rear of the drawer body 61.

Experiments reveal that, in a case in which air is supplied toward the front of the drawer body 61, the air moves along the inclined rack bodies 651, thereby improving drying efficiency of laundry.

Meanwhile, the rack 65 may further include a plurality of rack body through holes 653 formed through the rack bodies 651 such that air flows through the rack bodies 651.

In addition, the rack 65 may further include rack inclined parts 659 rotatably coupled to the rack bodies 651 via the rack body connection shafts 655.

The rack inclined parts 659 are inclined from the drawer body 61 toward the partition wall 51. In a case in which the inclined parts 613 provided at the drawer body 61 are located at only the opposite corners at which the inclined parts 613 faces each other (see FIG. 9), the rack inclined parts 659 may be located in a direction perpendicular to the inclined parts 613 (at the front corner and the rear corner of the drawer body 61).

On the other hand, as shown in FIG. 11, the rack 65 may include a rack body 651 provided in the drawer body 61, a body support part 657 to space the rack body 651 from the bottom of the drawer body 61 by a predetermined distance so as to improve drying efficiency, and rack inclined parts 659 provided at opposite ends of the rack body 651 such that the rack inclined parts 659 are inclined toward the partition wall 51.

In this embodiment, the rack body 651 may include a plurality of rack body through holes 653 divided by ribs 654. In this case, the body support part 657 may extend from the ribs 654 toward the bottom of the drawer body 61.

In addition, the body support part 657 may include a pair of plates spaced apart from each other by the width of each rib 654.

Furthermore, in this embodiment, the rack 65 may further include rib through holes 656 formed through the ribs 654 and support part through holes 658 formed through the body support part 657. The rib through holes 656 and the support part through holes 658 are provided to easily dry the laundry received in the drawer 6.

The rack body 651 may be provided with a protruding part 652 protruding toward the partition wall 51. The protruding part 652 may protrude toward any one selected from between the first connection channel fixing hole 511 and the supply channel fixing hole 517.

Air supplied into the drawer 6 through the first connection channel 813 or the drawer supply channel (second supply channel) 715 is guided by the protruding part 652 such that the air moves from the middle of the drawer body 61 to the edge of the drawer body 61, thereby improving drying efficiency.

Although FIG. 11 shows a case in which the rack body 615 is provided with only one protruding part 652, the protruding part 652 may include a protruding part protruding toward the first connection channel fixing hole 511 and a protruding part protruding toward the supply channel fixing hole 517 as shown in FIG. 1.

As is apparent from the above description, the present invention provides a laundry treating apparatus that supplies air to a plurality of receiving spaces provided to dry laundry.

In addition, the present invention provides a laundry treating apparatus that is capable of simultaneously supply air to a plurality of receiving spaces in which laundry is received and selectively supplying air only to a specific one of the receiving spaces.

In addition, the present invention provides a laundry treating apparatus configured such that air blowing means to supply air to a plurality of receiving spaces are individually provided in the respective receiving spaces.

In addition, the present invention provides a laundry treating apparatus with high drying efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a first cabinet having a first receiving space to receive laundry;

a second cabinet having a second receiving space to receive laundry, the second cabinet being separated from the first cabinet;

a partition wall located at an upper part of the second receiving space to divide an interior of the second cabinet;

a supply unit to selectively supply air to the first receiving space and the second receiving space;

a discharge unit comprising an exhaust duct to discharge air in the first receiving space out of the first cabinet and a suction fan provided adjacent to the partition wall such that the suction fan is located in the second cabinet to suction air from the second receiving space such that the air from the second receiving space moves to the exhaust duct, wherein the exhaust duct comprises:

a duct body provided in the first cabinet to allow the first receiving space to communication with an outside of the first cabinet therethrough;

a first connection channel connected between the duct body and the second receiving space to guide air from the duct body to the second receiving space; and a second connection channel connected between the duct body and the second receiving space, the suction fan being provided in the second connection channel, and wherein the supply unit comprises:

a heating channel provided in the first cabinet to heat air, the heating channel having a heater to heat air and a first discharge port and a second discharge port to discharge the heated air;

a first supply channel connected between the first discharge port and the first receiving space;

a second supply channel to allow the second discharge port and the second receiving space to communicate with each other therethrough; and a supply damper to selectively open the first discharge port and the second discharge port.

2. The laundry treating apparatus according to claim 1, wherein the discharge unit further comprises an exhaust fan provided in the duct body such that the exhaust fan is located between the first receiving space and the first connection channel to move air from the first receiving space to the duct body.

3. The laundry treating apparatus according to claim 2, wherein the discharge unit further comprises:

a first exhaust damper to open any one selected from between the first connection channel and the duct body; and a second exhaust damper to open any one selected from between the second connection channel and the duct body.

4. The laundry treating apparatus according to claim 3, wherein the discharge unit further comprises a dehumidification unit located between the exhaust fan and the first connection channel to dehumidify air discharged from the first receiving space.

5. The laundry treating apparatus according to claim 4, further comprising a drive unit having a first rotary shaft to rotate the first receiving space and a second rotary shaft to rotate the exhaust fan.

6. The laundry treating apparatus according to claim 1, wherein the partition wall comprises:

a first connection channel fixing hole to allow the first connection channel to communicate with the second receiving space therethrough;

a second connection channel fixing hole to allow the suction fan to communicate with the second receiving space therethrough; and a supply channel fixing hole to allow the second supply channel to communicate with the second receiving space therethrough.

7. The laundry treating apparatus according to claim 6, further comprising an introduction preventing unit located below the second connection channel fixing hole to prevent laundry in the second receiving space from being introduced into the suction fan.

8. The laundry treating apparatus according to claim 6, wherein the second connection channel fixing hole comprises a plurality of second connection channel fixing holes provided at the partition wall, and the discharge unit further comprises a fan supply channel connected between the second connection channel fixing holes and the suction fan.

9. The laundry treating apparatus according to claim 8, wherein the second connection channel fixing holes comprise at least one selected from between a plurality of holes provided along an edge of the partition wall and plurality of holes arranged from the edge of the partition wall toward a middle of the partition wall.

10. The laundry treating apparatus according to claim 6, further comprising a diffusion unit provided below the partition wall to diffuse air introduced into the second receiving space through at least one selected from between the first connection channel and the second supply channel in the second receiving space.

11. The laundry treating apparatus according to claim 10, wherein the diffusion unit comprises:

a diffusion plate provided below the first connection channel fixing hole; and a plurality of spacers provided along an outer circumference of the diffusion plate at intervals such that the diffusion plate is spaced apart from the first connection channel fixing hole by a predetermined distance.

12. The laundry treating apparatus according to claim 10, wherein the diffusion unit comprises:

a diffusion plate provided below the supply channel fixing hole; and a plurality of spacers provided along an outer circumference of the diffusion plate at intervals such that the diffusion plate is spaced apart from the supply channel fixing hole by a predetermined distance.

13. The laundry treating apparatus according to claim 10, wherein the diffusion unit comprises:

a diffusion plate provided below the partition wall;

a spacer provided to surround the first connection channel fixing hole, the second connection channel fixing hole, and the supply channel fixing hole such that the diffusion plate is spaced apart from the partition wall by a predetermined distance;

a connection channel connection pipe formed through the diffusion plate such that the connection channel connection pipe is connected to the second connection channel fixing hole; and a plurality of supply holes formed through the diffusion plate.

14. The laundry treating apparatus according to claim 13, wherein the supply holes comprise at least one selected from between a plurality of first supply holes provided along a edge of the diffusion plate and a plurality of second supply holes arranged from the edge of the diffusion plate toward a middle of the diffusion plate.

15. The laundry treating apparatus according to claim 13, wherein the second cabinet is provided below the first cabinet to support the first cabinet, and the second receiving space comprises a drawer configured to be drawn from the second cabinet.

16. The laundry treating apparatus according to claim 15, wherein the drawer is provided with a rack to space laundry from a bottom of the drawer by a predetermined distance, and the rack comprises:

a rack body provided in the drawer;

a protruding part protruding from the rack body toward at least one selected from between the second connection channel fixing hole and the supply channel fixing hole;

a plurality of rack body through holes formed through the rack body; and a body support part provided at the rack body to space the rack body from a bottom of the drawer by a predetermined distance.

17. The laundry treating apparatus according to claim 16, wherein the rack comprises:

a rib to divide the rack body through holes from each other; a rib through hole formed through the rib such that an upper side of the rack body communicates with a lower side of the rack body through the rib through hole; and a support part through hole formed through the body support part.

18. The laundry treating apparatus according to claim 16, wherein the rack further comprises a rack inclined part provided at an edge of the rack body such that the rack inclined part is at an angle to the partition wall, and the drawer further comprises an inclined part provided at an edge of the drawer such that the inclined part of the drawer is at an angle to the partition wall, wherein the inclined part of the drawer is perpendicular to the rack inclined part.

* * * * *